US008857115B2

(12) United States Patent
Epple

(10) Patent No.: US 8,857,115 B2
(45) Date of Patent: Oct. 14, 2014

(54) COMPOSITE STEP TREAD

(75) Inventor: Thomas A. Epple, Fort Wayne, IN (US)

(73) Assignee: Trivector Manufacturing, Fort Wayne, IN (US)

( * ) Notice: Subject to any disclaimer, the term of this patent is extended or adjusted under 35 U.S.C. 154(b) by 113 days.

(21) Appl. No.: 13/283,066

(22) Filed: Oct. 27, 2011

(65) Prior Publication Data

US 2012/0102855 A1 May 3, 2012

Related U.S. Application Data

(60) Provisional application No. 61/407,255, filed on Oct. 27, 2010.

(51) Int. Cl.

| | |
|---|---|
| ***E04F 11/02*** | (2006.01) |
| ***E04F 11/09*** | (2006.01) |
| ***E04H 4/14*** | (2006.01) |

(52) U.S. Cl.

CPC ..... *E04H 4/144* (2013.01)
USPC ..... 52/184; 52/182; 4/496

(58) Field of Classification Search

CPC ..... E04F 11/02; E04F 11/1043; E04F 11/104; E04F 11/09; E04F 2011/1897; E04F 11/1041; E04H 4/144
USPC ..... 4/496, 504, 506; 52/182, 183, 184, 186, 52/188, 190, 191, 741.2
See application file for complete search history.

(56) References Cited

U.S. PATENT DOCUMENTS

| | | | | | |
|---|---|---|---|---|---|
| 1,113,368 | A | * | 10/1914 | Nesdall | 52/191 |
| 1,343,739 | A | * | 6/1920 | Nesdall | 52/191 |
| 1,593,360 | A | * | 7/1926 | Hiram et al. | 52/191 |
| 1,673,178 | A | * | 6/1928 | Bois | 52/191 |
| 1,701,659 | A | * | 2/1929 | Bechtel | 52/191 |
| 1,799,405 | A | * | 4/1931 | Bois | 52/191 |
| 2,190,446 | A | * | 2/1940 | Fioritto | 52/182 |
| 2,206,862 | A | * | 7/1940 | Boyd | 52/182 |
| 2,377,994 | A | * | 6/1945 | Cocken, Jr. | 52/182 |
| 3,236,012 | A | * | 2/1966 | Laven | 52/184 |
| 3,374,491 | A | * | 3/1968 | Patin et al. | 52/169.7 |
| 3,499,254 | A | * | 3/1970 | Jefferys | 52/179 |
| 3,608,256 | A | * | 9/1971 | Jefferys | 52/182 |

(Continued)

FOREIGN PATENT DOCUMENTS

| | | | |
|---|---|---|---|
| FR | 2716406 | A1 * | 8/1995 |
| FR | 2905132 | A1 * | 2/2008 |
| WO | WO 2013134818 | A1 * | 9/2013 |

OTHER PUBLICATIONS

Dictionary definition of "seal", p. 1876, McGraw-Hill Dictionary of Scientific and Technical Terms (6th edition, 2003) (3 pages total).*

*Primary Examiner* — Basil Katcheves
*Assistant Examiner* — Rodney Mintz
(74) *Attorney, Agent, or Firm* — Taylor IP, P.C.

(57) ABSTRACT

A step for ingress and egress from a swimming pool and/or a spa includes a tread including opposing side edges, a riser coupled with and extending substantially perpendicular from one of the side edges of the tread and an upper flange substantially perpendicular to said tread and coupled with and extending upwardly or downwardly from one of the opposing side edges of the tread opposite the riser. The upper flange is configured to be coupled with the riser of another step or a wall of the swimming pool or spa to form a stairway.

6 Claims, 7 Drawing Sheets

(56) References Cited

U.S. PATENT DOCUMENTS

| | | | | | |
|---|---|---|---|---|---|
| 3,755,981 | A * | 9/1973 | West | 52/184 |
| 3,759,000 | A * | 9/1973 | Balzer et al. | 52/179 |
| 3,839,840 | A * | 10/1974 | Miller | 52/741.2 |
| 4,001,991 | A * | 1/1977 | Balzer et al. | 52/179 |
| 4,112,641 | A * | 9/1978 | Balzer | 52/179 |
| 4,468,901 | A * | 9/1984 | Henderson et al. | 52/79.6 |
| 4,589,237 | A * | 5/1986 | Dahowski | 52/169.7 |
| 4,599,835 | A * | 7/1986 | Rinke | 52/184 |
| 4,709,520 | A * | 12/1987 | Vochatzer | 52/191 |
| 4,819,391 | A * | 4/1989 | Tassin et al. | 52/182 |
| 4,873,802 | A * | 10/1989 | Dahowski | 52/184 |
| 4,951,434 | A * | 8/1990 | Schmidt | 52/191 |
| 5,014,475 | A * | 5/1991 | Anderson et al. | 52/191 |
| 5,067,228 | A * | 11/1991 | Gardenier | 29/525.01 |
| 5,167,102 | A * | 12/1992 | Nakatsubo et al. | 52/188 |
| 5,349,795 | A * | 9/1994 | French et al. | 52/183 |
| 5,644,873 | A * | 7/1997 | Bourgault | 52/182 |
| 5,660,009 | A * | 8/1997 | Cousin | 52/183 |
| 5,680,730 | A * | 10/1997 | Epple | 52/28 |
| 5,752,350 | A * | 5/1998 | Maiuccoro | 52/169.7 |
| 5,794,391 | A * | 8/1998 | Howard | 52/182 |
| 5,799,448 | A * | 9/1998 | Dunk | 52/188 |
| 5,899,032 | A * | 5/1999 | Buzby | 52/182 |
| 6,000,494 | A * | 12/1999 | Wilson | 182/93 |
| 6,044,598 | A * | 4/2000 | Elsasser et al. | 52/181 |
| 6,318,033 | B1 * | 11/2001 | Birch et al. | 52/182 |
| 6,438,909 | B2 * | 8/2002 | Birch et al. | 52/182 |
| 6,467,234 | B1 * | 10/2002 | Marshall | 52/741.2 |
| 6,665,987 | B2 * | 12/2003 | Eve et al. | 52/182 |
| 6,758,016 | B2 * | 7/2004 | Gobeil | 52/191 |
| 6,796,090 | B2 * | 9/2004 | Kambara | 52/182 |
| 6,966,405 | B2 * | 11/2005 | St-Pierre et al. | 182/93 |
| 7,040,060 | B2 * | 5/2006 | Cox | 52/169.7 |
| 7,047,699 | B2 * | 5/2006 | Kennedy | 52/184 |
| 7,165,362 | B2 * | 1/2007 | Jobs et al. | 52/188 |
| 7,617,652 | B1 * | 11/2009 | Flatmoe | 52/653.2 |
| 7,849,643 | B2 * | 12/2010 | Kennedy | 52/188 |
| D646,955 | S * | 10/2011 | Sanders et al. | D8/354 |
| 8,104,576 | B2 * | 1/2012 | Schwoerer | 182/120 |
| 8,112,951 | B2 * | 2/2012 | Gravel | 52/182 |
| 8,661,749 | B2 * | 3/2014 | Gibson | 52/182 |
| 8,707,637 | B1 * | 4/2014 | Nerad | 52/183 |
| 2001/0000841 | A1 * | 5/2001 | Birch et al. | 52/182 |
| 2002/0029532 | A1 * | 3/2002 | Eve et al. | 52/182 |
| 2002/0124492 | A1 * | 9/2002 | Gobeil | 52/191 |
| 2002/0189177 | A1 * | 12/2002 | Eve et al. | 52/184 |
| 2004/0144044 | A1 * | 7/2004 | Cox | 52/182 |
| 2006/0150540 | A1 * | 7/2006 | Kennedy | 52/182 |
| 2006/0272083 | A1 * | 12/2006 | Kruger | 4/496 |
| 2009/0293385 | A1 * | 12/2009 | Vargas | 52/191 |
| 2009/0308003 | A1 * | 12/2009 | Juneau et al. | 52/184 |
| 2011/0067328 | A1 * | 3/2011 | Naccarato et al. | 52/182 |
| 2011/0078962 | A1 * | 4/2011 | Gravel | 52/169.7 |
| 2011/0214369 | A1 * | 9/2011 | Weber et al. | 52/188 |
| 2011/0225906 | A1 * | 9/2011 | Kennedy et al. | 52/188 |
| 2012/0167494 | A1 * | 7/2012 | Brooks et al. | 52/182 |
| 2012/0192515 | A1 * | 8/2012 | Petta | 52/302.1 |
| 2012/0266550 | A1 * | 10/2012 | Naccarato et al. | 52/182 |
| 2012/0297705 | A1 * | 11/2012 | Kay | 52/179 |
| 2013/0007956 | A1 * | 1/2013 | Korbel | 4/506 |
| 2013/0167457 | A1 * | 7/2013 | Gibson | 52/177 |
| 2014/0123590 | A1 * | 5/2014 | Maiuccoro | 52/741.2 |

* cited by examiner

COMPOSITE STEP TREAD

CROSS REFERENCE TO RELATED APPLICATIONS

This is a non-provisional application based upon U.S. Provisional Patent Application Ser. No. 61/407,255, entitled "COMPOSITE STEP TREAD", filed Oct. 27, 2010, which is incorporated herein by reference.

BACKGROUND OF THE INVENTION

1. Field of the Invention

The present invention relates to a composite step for a walk-in stairway for ingress to and egress from a swimming pool or spa.

2. Description of the Related Art

Swimming pools or spas may be constructed using different techniques, such as gunite over concrete, or a vinyl liner over steel or plastic walls. A swimming pool usually also has walk-in steps at the shallow end of the pool. The walk-in steps may be integrally formed with the side wall of the pool through the use of forms and concrete or may be subsequently positioned in the pool after the wall structure has been formed.

What is needed in the art is a composite step for a walk-in stairway for ingress and egress of a swimming pool or spa which is inexpensive to manufacture and which may be utilized to quickly and efficiently construct a stairway.

SUMMARY OF THE INVENTION

The present invention provides a step for ingress and egress from a swimming pool or spa. The step includes a tread having opposing side edges, a riser coupled with and extending substantially perpendicular from one of the opposing side edges of the tread and an upper flange which is substantially perpendicular to the tread and coupled with and extending upwardly or downwardly from one of the opposing side edges of the tread which is opposite the riser. The upper flange is configured to be coupled with the riser of another step and/or a wall of a swimming pool or spa to form a stairway.

The invention in another form is directed to a stairway for ingress and egress of a swimming pool or spa. The stairway includes at least two composite steps, each of which includes a tread having opposing side edges, a riser coupled with and extending substantially perpendicular from one of the opposing side edges of the tread and an upper flange which is substantially perpendicular to the tread and coupled with and extending upwardly or downwardly from one of the opposing side edges of the tread opposite the riser. The upper flange is configured to be coupled with the riser of another step and/or the wall of the swimming pool or spa. The stairway further includes and at least one fastener for firmly coupling the composite steps to form the stairway.

The present invention further provides a method of manufacturing a stairway for a swimming pool or spa. The method according to the present invention includes the step of forming at least two steps by extrusion of a material. Each of the steps includes a tread having opposing side edges, a riser extending substantially perpendicular from the tread and an upper flange substantially perpendicular to the tread and coupled with and extending upwardly or downwardly from one of the opposing side edges of the tread opposite the riser. The method of the present invention further provides the step of forming a first set of openings along a bottom of the riser of at least one of the composite steps. A second set of openings corresponding with the first set of openings is formed along a length of the upper flange of at least one other of the steps. The first set of openings of one step is aligned with the corresponding second set of openings of another step and at least one fastener is inserted through the aligned openings to firmly couple the steps to form a stairway.

The present invention also provides a second embodiment of manufacturing a stairway for ingress and egress of a swimming pool or spa which includes the step of providing a predetermined number of preformed composite steps, each having a riser and a tread. The preformed composite steps are secured to a vertical support member and a back edge of the tread of one of the preformed composite steps is secured to a bottom of a riser of another preformed composite step, this step being repeated a predetermined number of times to form a stairway. Additionally an interconnecting strip is secured at a juncture between each of the securely coupled preformed composite steps.

An advantage of the present invention is a strong and aesthetically pleasing stairway for a pool or spa can be quickly and efficiently manufactured. For example, each composite step may be formed from a single piece of material, for example by the process of extrusion, thus minimizing the number of parts required to construct a stairway for a pool or spa.

Another advantage of the present invention is that the composite steps may be manufactured in bulk and a predetermined number of the composite steps then selected to construct the stairway for a particular spa or pool.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
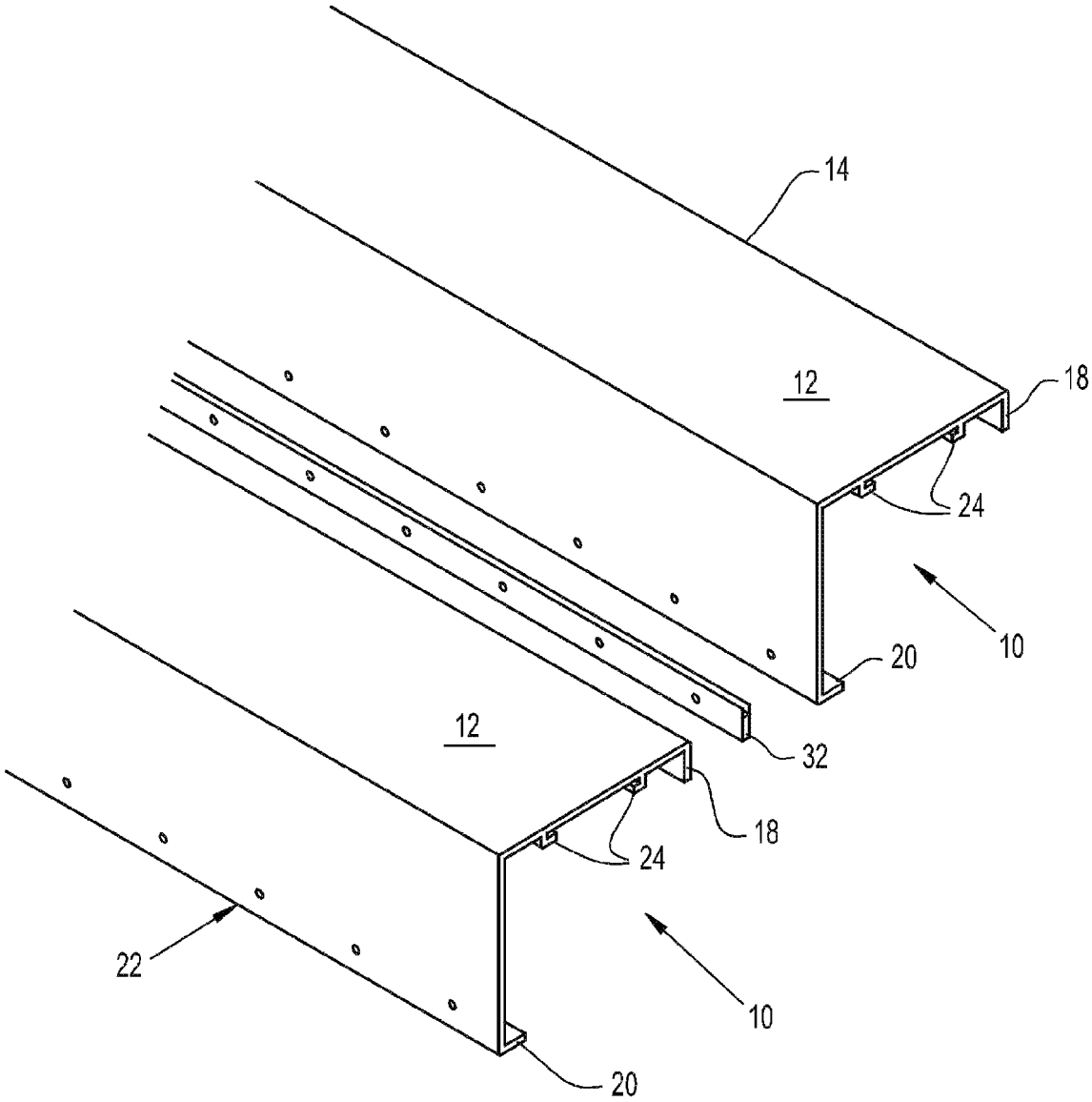
FIG. 1 is an exploded view of a stairway according to the present invention.
Figure 2:
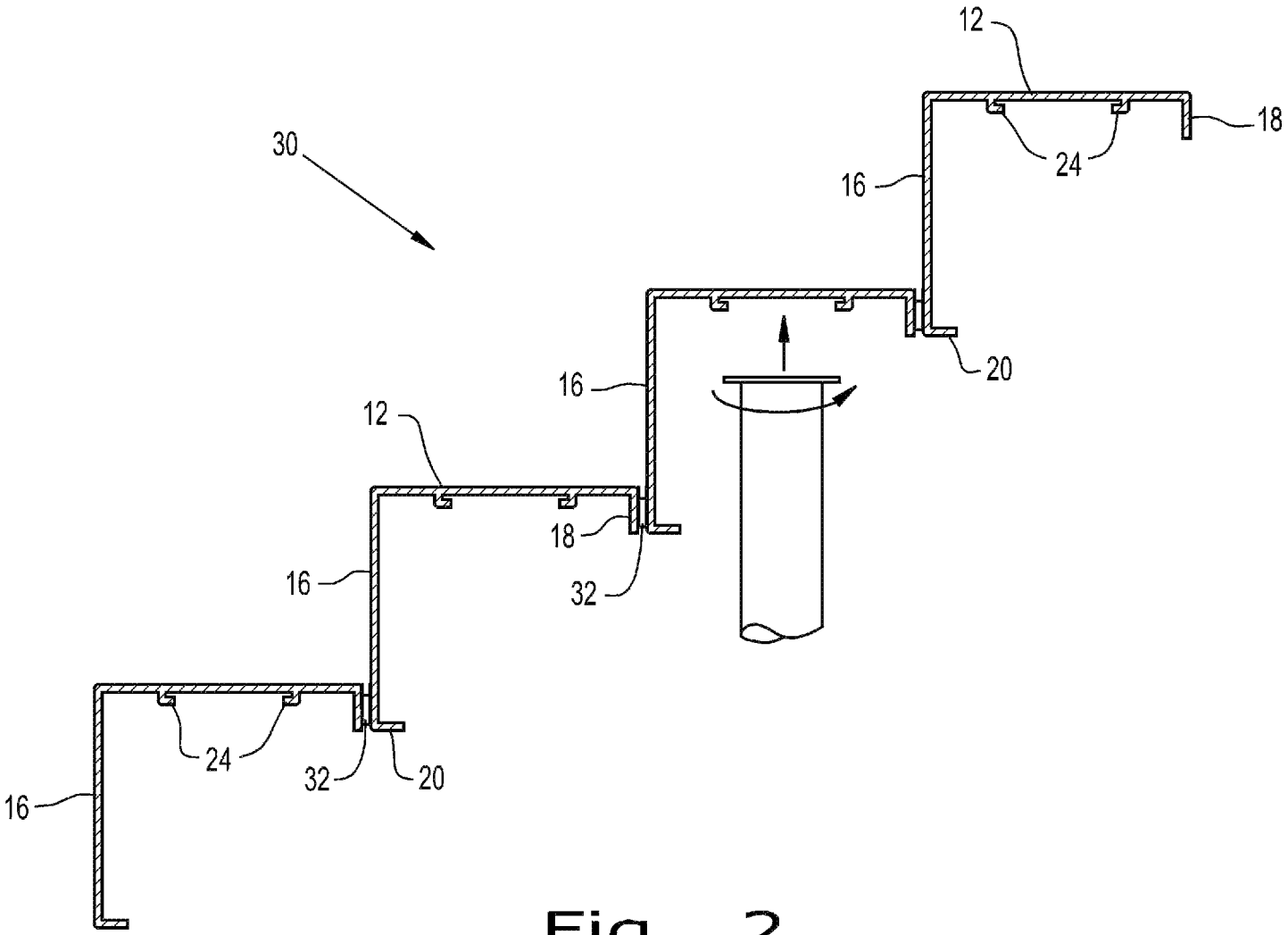
FIG. 2 is a side view of the stairway of FIG. 1.
Figure 3:
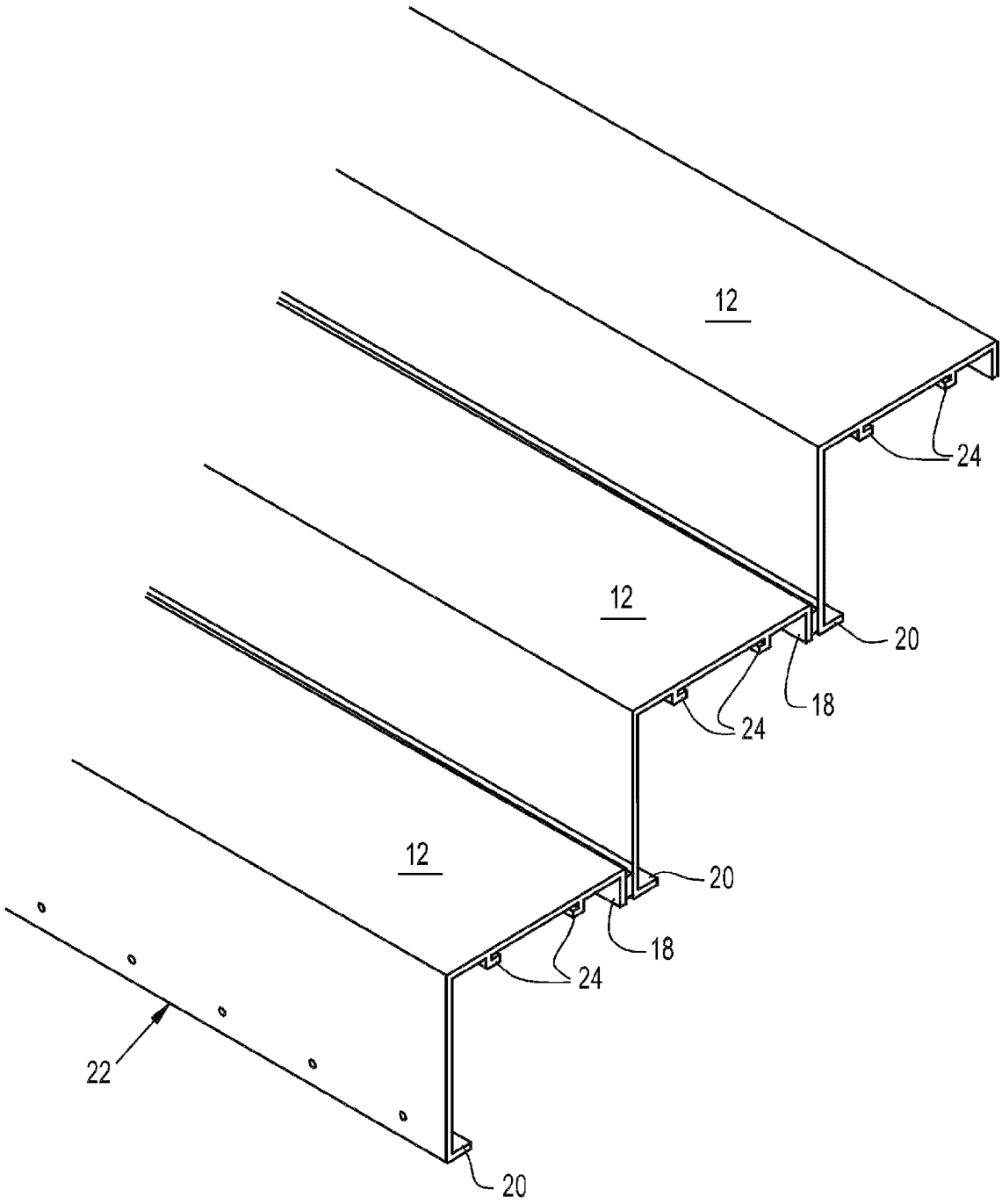
FIG. 3 is a perspective view of the stairway of FIG. 1.

Referring now to the drawings, and more particularly to FIGS. 1-4, there is shown composite step 10 for stairway 30 for a pool or a spa. Composite step 10 includes tread 12 having opposing side edges 14, riser 16 and upper flange 18. Riser 16 is coupled with and extends substantially perpendicular from one of the opposing side edges 14 of tread 12. Upper flange 18 is substantially perpendicular to tread 12 and is coupled with and extends upwardly or downwardly from side edge 14 which is opposite riser 16. Upper flange 18 is configured to be coupled with riser 16 and/or a wall of a swimming pool or spa to form a stairway. Advantageously, composite step 10 may be formed from a single piece of material, for example, by the process of extrusion.

Composite step 10 may further include lower flange 20 extending substantially perpendicular from bottom edge 22. Lower flange 20 provides additional strength and support for composite step 10, thereby increasing the weight load which the step and/or a stairway formed from step(s) 10 can bear.

Figure 4:
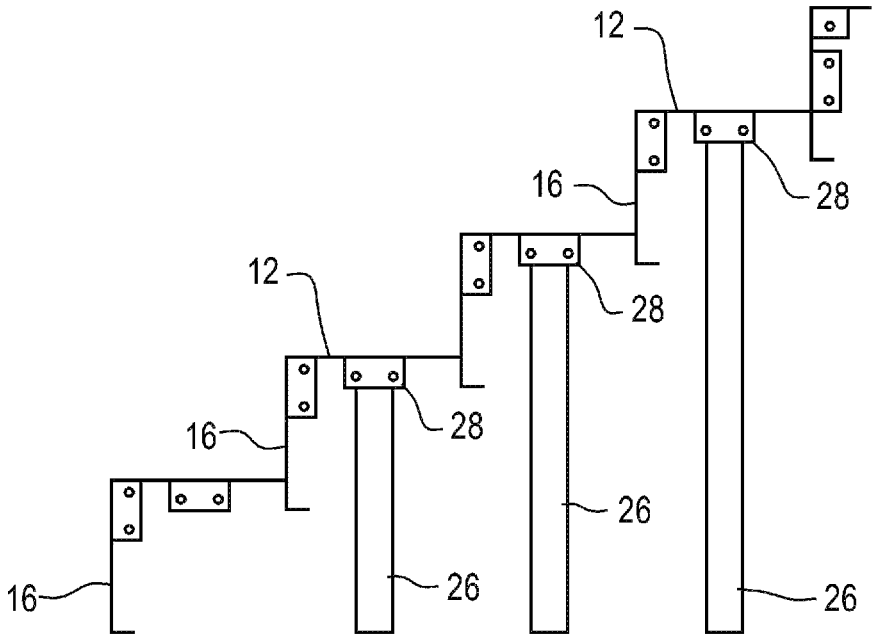
FIG. 4 is a side view of the stairway of FIG. 1.

Composite step 10 may also include at least one protrusion 24, for example a set of protrusions, defining a longitudinally extending slot which is configured to receive at least one vertical support 26. Vertical support 26 may be, for example, a pole, a pipe or a post and may further include a support cup 28 for receiving the pole, pipe or post, as shown in FIG. 4.

The composite step according to the present invention is formed from a material such as, for example, a thermoplastic material, fiberglass, polyvinyl chloride (PVC) or recycled plastic.

The present invention further provides stairway 30 for ingress and egress of a swimming pool or spa. Stairway 30 includes a predetermined number of composite steps 10, each of which includes tread 12 having opposing edge sides 14, riser 16 coupled with and extending substantially perpendicular from one of side edges 14 of the tread, upper flange 18 which is substantially perpendicular to tread 12 and coupled with and upwardly or downwardly extending from opposing edge 14 which is opposite riser 16. Stairway 30 further includes at least one fastener (not shown) for firmly coupling or securing composite steps 10 together. At least one of the predetermined number of composite steps may further include lower flange 20 extending substantially perpendicular from a bottom edge of riser 16.

At least one of the predetermined number of composite steps 10 of stairway 30 may include at least one protrusion, for example a set of protrusions, extending from a lower surface of tread 12, the at least one protrusion defining a longitudinally extending slot which is configured to receive at least one vertical support member 26, which may be in the form of, for example, a pole, pipe or a post. Vertical support member 26 may further include a support cup 28 which is configured to receive the pole, pipe or post.

Stairway 30 may further include interconnecting strip 32 which is positioned between adjoining composite steps 10. The interconnecting strip is a sealing strip, bead receiver, or other suitable elongate structure used to interconnect the steps together. The interconnecting strip is formed, for example, from rubber, polyurethane, silicone rubber, rubber coated metal, a fluoroelastomer, fiberglass or polytetrafluoroethylene (PTFE). Interconnecting strip 32 may include a set of openings which are positioned to align with a set of openings on each of the adjoining steps such that a fastener such as a screw, bolt or rivet can be inserted through the aligned openings to securely fasten the two adjoining steps and the interconnecting strip together.

Optionally, stairway 30 may include a handrail (not shown) which is securely coupled with at least one of the composite steps 10 and which serves to provide additional support during ingress and egress. A further embodiment of the stairway of the present invention includes at least two composite steps 10 which may have the same or differing lengths.

Figure 5:
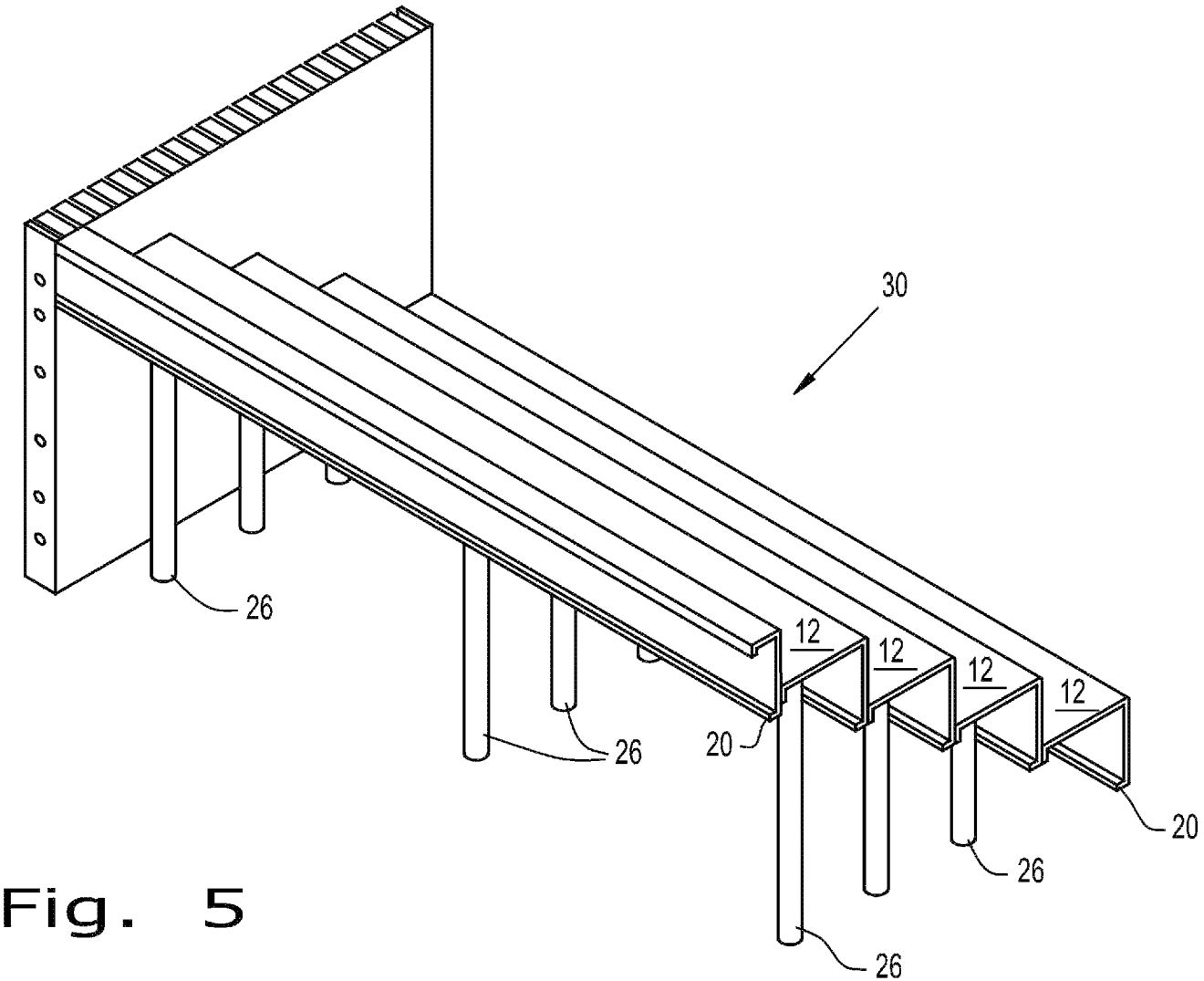
FIG. 5 is a rear perspective view of a stairway according to the present invention.
Figure 8:
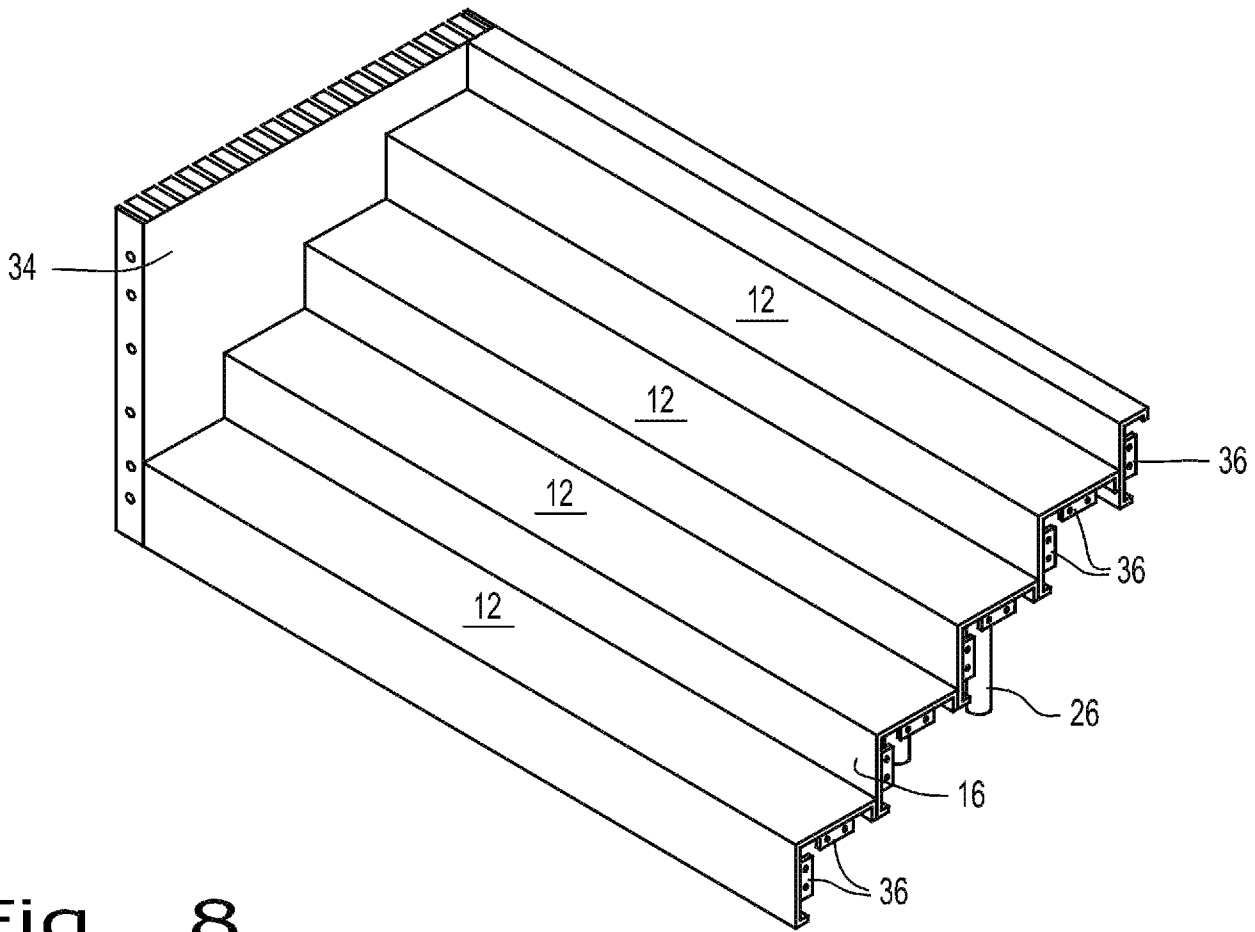
FIG. 8 is a perspective view of a stairway according to the present invention.

Referring now to FIGS. 5 and 8, there is shown an embodiment of the stairway 30 according to the present invention including wall 34 fastened to the stairway in such a way as to enclose at least one side of the stairway. Stairway 30 may include, for example, two walls for enclosing both sides of the stairway.

Figure 6:
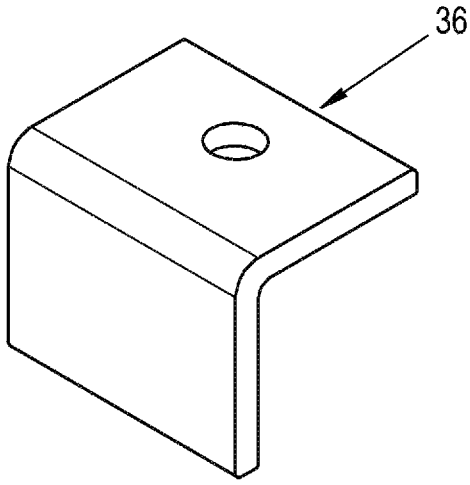
FIG. 6 is a perspective view of a bracket.
Figure 7:
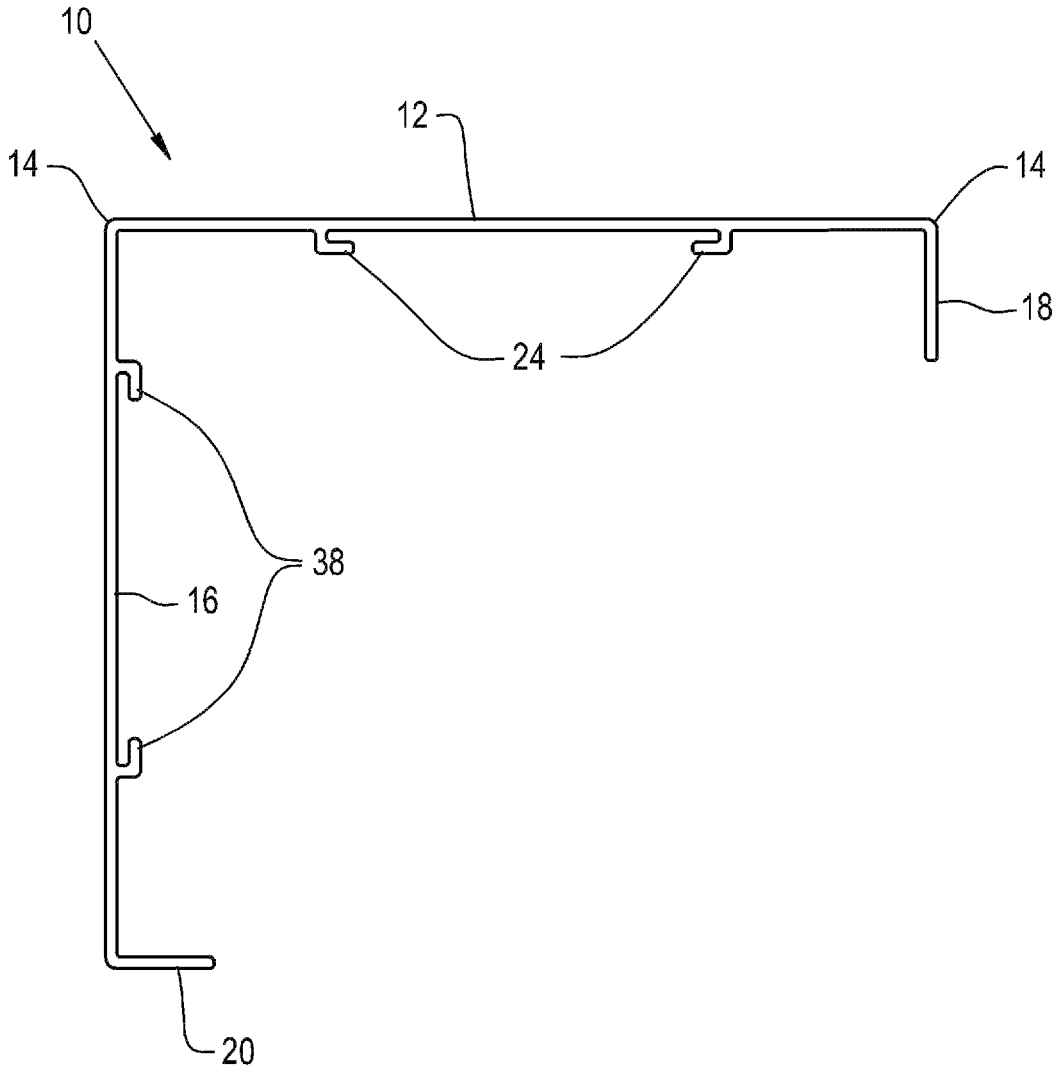
FIG. 7 is a side view of a composite step according to the present invention.

Referring now to FIG. 6, according to another embodiment of the stairway of the present invention, a device configured for securing stairway 30 to wall 34 or to a wall of the pool or spa is provided in the form of a plurality brackets 36 may be provided which are attached, for example, by a screw, bolt or rivet to both the stairway and a wall of the pool or spa. As illustrated in FIG. 7, inventive steps 10 of stairway 30 may further include a second set of protrusions 38 extending from riser 16 which are configured to slidingly receive bracket 36 to firmly secure stairs 10 to wall 34 or to a wall of the pool or spa.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A stairway for ingress and egress of a swimming pool or a spa, the stairway comprising:

at least two composite steps including a first step and a second step, an interconnecting sealing strip positioned between said first step and said second step, said interconnecting sealing strip for sealing said first step with said second step, each of said first step and said second step including:

a tread including opposing side edges;

at least one vertical support member coupled with said tread and including a support cup configured to receive one of a pole, a pipe and a post;

at least one protrusion extending from a lower surface of said tread, said at least one protrusion defining a longitudinally extending slot configured to receive said at least one vertical support member;

a riser coupled with and extending substantially perpendicular from one of said side edges of said tread, said riser including at least one pair of protrusions configured to slidingly receive at least one angle bracket;

an upper flange substantially perpendicular to said tread and coupled with and one of upwardly and downwardly extending from one of said opposing side edges of said tread opposite said riser, said upper flange configured to be coupled with one of said riser of another step and a wall of the swimming pool or spa;

at least one fastener for firmly coupling said first step with said second step to form the stairway;

a device configured for securing the stairway to the wall of the swimming pool or spa, said device including at least one angle bracket and at least one screw, bolt or rivet;

at least one of said first step and said second step further comprising a lower flange extending substantially perpendicular from a bottom of said riser; and wherein said interconnecting sealing strip is positioned between a bottom portion of said first step and said upper flange of said second step.

2. The stairway according to claim 1, further comprising at least one wall fastened to the stairway to enclose at least one side of the stairway.

3. The stairway according to claim 1, wherein said at least two steps have one of a same and differing lengths.

4. The stairway according to claim 1, wherein said interconnecting sealing strip is formed from one of rubber, polyurethane, silicone rubber, rubber coated metal, a fluoroelastomer, fiberglass and polytetrafluoroethylene (PTFE).

5. The stairway according to claim 1, wherein each of said at least two composite steps is formed from a single piece of material by extrusion of said material.

6. The stairway according to claim 5, wherein said single piece of material is one of a thermoplastic material, fiberglass, polyvinyl chloride (PVC), and recycled plastic.

* * * * *